United States Patent [19]

Raasch et al.

[11] Patent Number: 4,524,578

[45] Date of Patent: Jun. 25, 1985

[54] APPARATUS FOR CONTROLLING THE THREAD JOINING PROCESS IN AN OPEN END ROTOR SPINNING MACHINE

[75] Inventors: Hans Raasch, Monchen-Gladbach; Manfred Lassmann, Nettetal, both of Fed. Rep. of Germany

[73] Assignee: W. Schlafhorst & Co., Monchen-Gladbach, Fed. Rep. of Germany

[21] Appl. No.: 441,233

[22] Filed: Nov. 12, 1982

[30] Foreign Application Priority Data

Nov. 11, 1981 [DE] Fed. Rep. of Germany ..... 3144761

[51] Int. Cl.[3] ..... D01H 15/00; D01H 13/18

[52] U.S. Cl. ..... 57/263

[58] Field of Search ..... 57/263, 264, 261, 22

[56] References Cited

U.S. PATENT DOCUMENTS

| | | | |
|---|---|---|---|
| 3,939,638 | 2/1976 | Bruckert et al. | 57/263 |
| 3,987,610 | 10/1976 | Stahlecker et al. | 57/263 |
| 4,020,621 | 5/1977 | Tsubata | 57/263 |
| 4,020,622 | 5/1977 | Lattion | 57/263 |
| 4,080,775 | 3/1978 | Stahlecker | 57/263 |
| 4,102,116 | 7/1978 | Derichs et al. | 57/263 |
| 4,159,616 | 7/1979 | Takeuchi et al. | 57/263 X |
| 4,172,357 | 10/1979 | Stahlecker et al. | 57/263 |

*Primary Examiner*—Donald Watkins

*Attorney, Agent, or Firm*—Herbert L. Lerner; Laurence A. Greenberg

[57] ABSTRACT

Method for controlling a thread joining process which takes place by starting a rotor in an open end rotor spinning machine, which includes beginning pre-feeding of a fiber quantity into the rotor which is required for thread joining, and subsequently controlling the pre-feeding speed after the chosen draft for the following spinning operation, and an apparatus for carrying out the method.

17 Claims, 1 Drawing Figure

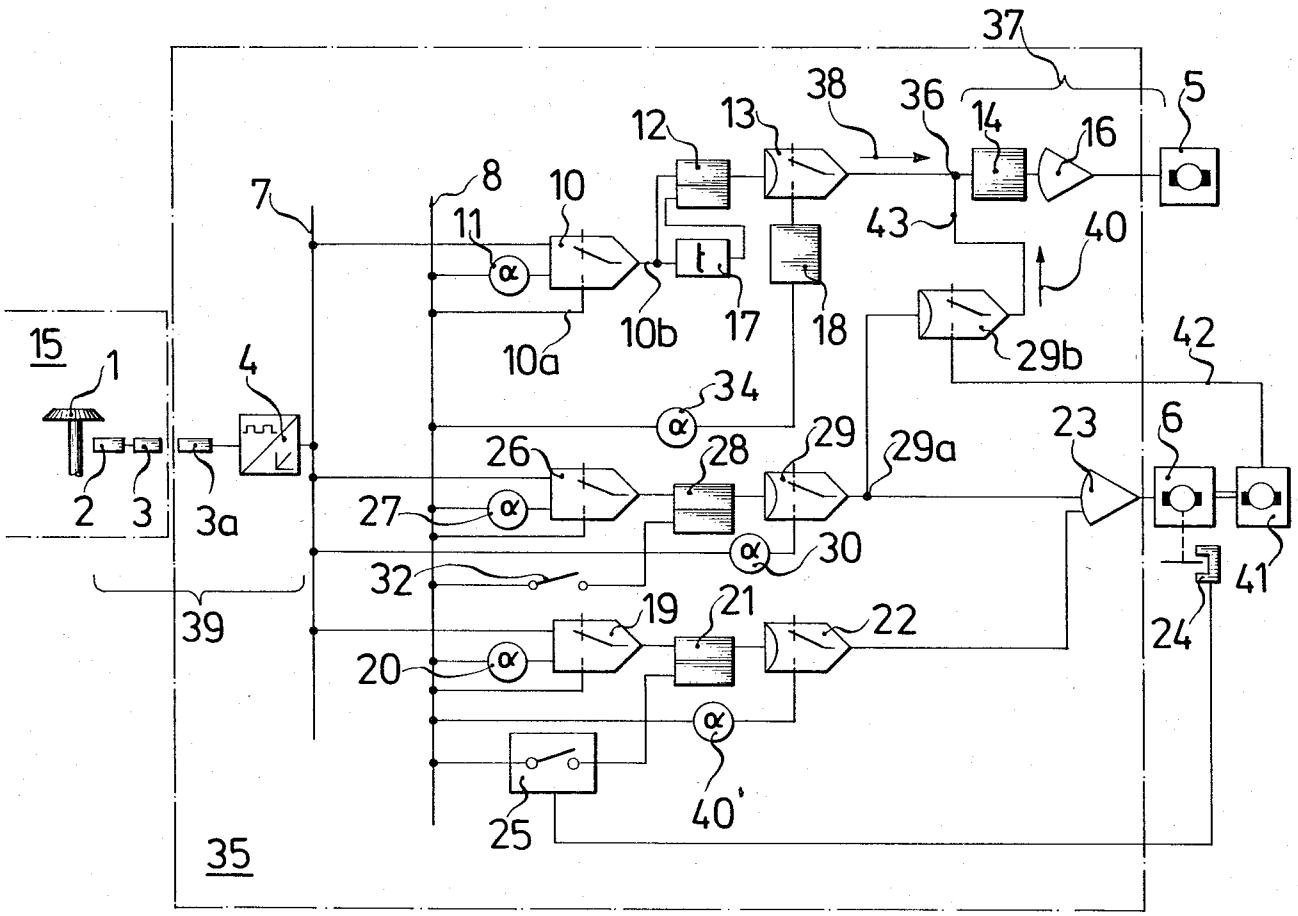
5
37
16
14
36
38
13
12
10b
10
8
11
10a
7
4
3a
3
2
1
15
39
35
42
40
43
29b
18
17
34
29a
29
28
26
27
32
30
23
6
41
24
22
21
19
20
25
40'

APPARATUS FOR CONTROLLING THE THREAD JOINING PROCESS IN AN OPEN END ROTOR SPINNING MACHINE

The invention relates to a method and apparatus for controlling a thread joining process, which occurs by starting a rotor in an open end rotor spinning machine.

It is known from German Published, Non-Prosecuted Application DE-OS No. 26 05 978 to begin to spin or join threads at a lower speed than the normal speed during the starting of the rotor and thereby to start and/or end the individual processes at given rotor speeds.

Thread joining security results, when the control is structured in such a way that the doffing of the thread joining from the rotor occurs at a rotor speed of between 30,000 and 40,000 revolutions per minute, the so-called thread joining speed. Before this moment, the fiber quantity which is necessary for the thread joining must be brought into the rotor as a pre-fed quantity and the thread is combined with the pre-fed fibers. In order for these steps to be finished before the thread joining speed is reached, the thread joining process must begin, for an average starting time of the rotor, at a speed of between 5,000 and 10,000 revolutions per minute.

In a disadvantageous manner, however, the fiber quantity in the known apparatus, which is in the form of a pre-feeding to the rotor, remains about the same, independently of the fineness of yarn. To avoid this, the pre-feeding should be changed separately for each change of the fineness of yarn which, if necessary, would require testing for each pre-feeding.

It is accordingly an object of the invention to provide a method and apparatus for controlling the thread joining process in an open end rotor spinning machine, which overcomes the hereinaforementioned disadvantages of the heretofore-known devices of this general type, to perfect the automatic thread joining, thereby improving the appearance, evenness and strength of the piecer, and to simplify and accelerate the change-over to another fineness of yarn.

With the foregoing and other objects in view, there is provided, in accordance with the invention, a method for controlling a thread joining or spinning process which takes place by starting a rotor in an open end rotor spinning machine, which comprises beginning pre-feeding of a fiber quantity into the rotor which is required for thread joining, and subsequently controlling the pre-feeding speed after the chosen draft for the following spinning operation.

In accordance with another mode of the operation, there is provided a method which comprises choosing values for a ratio of pre-feeding speed to draft by choosing a larger value by using a higher pre-feeding speed and choosing a smaller value by using a lower pre-feeding speed.

In order to carry out the method of the invention, there is provided an apparatus for controlling a thread joining or spinning process which takes place by starting a rotor in an open end rotor spinning machine, comprising at least one spinning unit of the open end rotor spinning machine, a control device connected to the at least one spinning unit for controlling pre-feeding of a required fiber quantity for thread joining and for controlling working or commercial spin fiber feed to the rotor, for return of a joined thread end to the rotor and for at least temporary control of thread unwinding from the rotor during the thread joining process, a thread unwinding device and a sliver drawing-in device connected to the control device at least during the thread joining process, an operation conncetion from the control device for pre-feeding to the sliver drawing-in device, and a control element connected in the operative connection at which a chosen draft for the spinning operation is adjustable.

In accordance with another feature of the operation, a fiber feeding device is connected to the control device at least during the thread joining process, being connected to the operative connection. The pre-feeding speed is controlled after the draft and therefore after the fineness of the yarn. However, since the respective mechanical and pneumatic elements which transport the sliver, disentangle the fibers and feed the disintegrated and individual fibers into the rotor and the fiber flow itself have different run up or acceleration and slow down characteristics, respectively, depending on the feeding speed, this results in a non-linear dependence between the pre-feeding speed and the draft. This fact can be taken into consideration if, in accordance with a further feature of the invention, there is provided another control element connected to the control device for pre-feeding, for taking run up and run out behavior of the fiber feeding into account.

According to another feature of the invention, after the thread joining, the sliver drawing-in and the fiber feeding is controlled according to the unwinding of the thread, whereby the possibility presents itself to adjust the chosen draft in advantageous manner at only one single control element.

In accordance with an added feature of the invention, the other control element is a function generator.

In accordance with an additional feature of the invention, there is provided a device for producing rotor signals, the operative connection leading from the device for production of rotor signals through the control device to the sliver drawing-in device and/or fiber feeding device.

In accordance with again another feature of the invention, there is provided another operative connection from the thread unwinding device to the sliver drawing-in device and/or fiber feeding device.

In accordance with again another feature of the invention, the other operative connection is switchable.

In accordance with again an added feature of the invention, there is provided a common running cable for both of the operative connections, leading to the sliver drawing-in device.

In accordance with again an additional feature of the invention, there is provided a common running cable for both of the operative connections, leading to the fiber feeding device.

In accordance with yet another feature of the invention, the control element is connected in the running cable.

In accordance with a concomitant feature of the invention, there is provided a tachometer generator connected to the thread unwinding device in the other operative connection.

The advantages obtained with the invention exist especially in that the quantity of the pre-fed fibers is always self-adjusted to the draft which is chosen for the spinning operation, and consequently neither high spots nor thin spots can occur at the piecer or at adjoining thread pieces, upon the occurence of a wrongly chosen pre-feeding.

The new apparatus can be provided at each particular spinning unit of an open end rotor spinning machine. However, this is not necessary, if the apparatus is movable and is only connected for the period of the thread joining to an appointed spinning unit. In this case, for the thread joining period, a connection can be made from the thread joining apparatus to the thread unwinding apparatus and/or to the sliver drawing-in apparatus or to the fiber feed apparatus of the spinning unit, respectively, such as through plugs.

Other features which are considered as characteristic for the invention are set forth in the appended claims.

Although the invention is illustrated and described herein as embodied in a method and apparatus for controlling the thread joining process in an open end rotor spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a diagrammatic and schematic circuit diagram of an embodiment of the invention.

Referring now to the FIGURE of the drawing in detail, there is seen a spinning unit 15 of an open end rotor spinning machine, which is not fully represented, and an apparatus 35 for the control of the thread joining process. The apparatus 35 is represented in the form of a block diagram.

The spinning unit 15 has a rotor 1. From the rotor 1, digital impulses proportional to the rotor speed are picked up through a receiver 2 and are transmitted without contact through a converter 3, 3*a* from the spinning unit 15 to the input of a digital/analog converter 4, which supplies direct current voltage proportional to the rotor speed at its output.

The drawing illustrates a direct current motor 5 which is part of a sliver drawing-in apparatus and a direct current motor 6 which is part of a thread unwinding and thread retracting or return installation. The direct current motor 6 is in the form of a reversing motor. The motors are constructed in such a way that they have a short starting time, and their speed is then adjusted proportional to the applied direct current voltage.

Through the connection with the output of the digital/analog converter 4, a direct current voltage proportional to the rotor speed is always applied to a line 7. A line 8 has a constant direct current voltage.

The parts 2, 3, 3*a* and 4 form a common apparatus 39 for the production of rotor signals.

From a line branching point 36, a running cable 37 leads to the direct current motor 5. The running cable 37 contains a control element 14 and an after-connected amplifier 16. An adjustable chosen draft for the spinning operation is located at the control element 14.

In the direction of an arrow 38 from the apparatus 39 for the production of rotor signals through the line branching point 36 and the running cable 37, all active components leading to the direct current motor 5, which will be described later in detail, form a common first operative connection. In the direction of the arrow 40 from the direct current motor 6 through the lead branching point 36 and the running cable 37, all active components, which will be described later in detail, from a common second operative connection. The running cable 37 is common for both operative connections.

A control input of a comparator 10 is connected to the line 7, and a second control input is connected to the line through a coefficient potentiometer. The connected or operating input of the comparator 10 is also connected to the line 8. As soon as the expected voltages at the control inputs of the comparator 10 are equal, the connected input 10*a* will be connected to the output 10*b*. The potentiometer 11 will be adjusted in such a way that the comparator 10 just changes over when the rotor has reached a certain speed $n_1$ at starting, and accordingly the line 7 has a correspondingly high voltage.

As soon as the comparator 10 has changed over, an after-connected memory 12 is set, which switches a digital/analog circuit or switch 23, that serves as a control apparatus for the pre-feeding. The connected or switched input of the circuit 13 is connected with the line 8 through a function generator 18 and a coefficient potentiometer 34, which serves as the ground setting. The output of the circuit 13 is connected with the line branching point 36. The function generator 18 takes the non-linear dependence of the pre-feeding speed from the chosen and adjusted draft into account.

In the same manner as the comparator 10, the control inputs of the comparators 26 and 19 are also connected to the lines 7 and 8. The same applies to the connected inputs, which are all connected to the line 8.

With the setting of the memory 12, a time element 17 is simultaneously connected, and the memory 12 is erased again at the expiration of an adjusted space of time t. In this way, the pre-feeding during a given space of time is in operation.

The potentiometer 20 is adjusted in such a way that the comparator 19 just changes over, when the rotor has reached a speed $n_2$ by starting. The output of the comparator 19 is connected to a memory 21. As soon as the output of the comparator 19 has a voltage, the memory 21 is set and the after-connected digital/analog circuit 22 is connected or switched. The connected or operating input of the circuit 22 is connected to the line 8 through a coefficient potentiometer 40'. The output of the circuit 22 is connected to the direct current motor 6 through an amplifier 23. As soon as the connection is made to the line 8, the direct current motor 6 starts up in the direction opposite the unwinding of the thread, for the purpose of rethreading. A thread length measuring instrument 24 constructed as a stepping selector is connected to the control input of a counter 25. The preselected number of steps is reached, which corresponds to the chosen return feed thread length, so that the erasing input of the memory 21 receives a voltage from the line 8 through the counter 25 so that the memory is erased and the circuit 22 opens. After switching off the circuit 22, the direct current motor 6 immediately remains standing which for example, can be caused through a known brake lifting set or solenoid device.

The coefficient potentiometer 27 is adjusted in such a way that the comparator 26 just changes over, when the rotor 1 has reached a speed $n_3$ by increasing the starting or acceleration. After the change over of the comparator 26 its output has a voltage, so that the after-connected memory 28 is set and the digital/analog circuit 29 is switched. The connected or switched input of the circuit 29 is connected to the line 7 through the coefficient potentiometer 30. After connecting the circuit 29, a voltage is applied which is a factor smaller than one, at the branching point 29*a* for the voltage of the lead 7. A branch leads to the control input of a digital analog circuit 29*b* and the other branch leads to the direct current motor 6 through the amplifier 23.

A tachometer generator 41 is connected to the direct current motor 6 and with the connected input of the circuit 29*b* through a lead 42. The output of the circuit 29*b* is connected with the line branching point 36 through a line 43.

As soon as the line branching point 29*a* has a voltage, the circuit 29*b* is also connected, so that the direct current motor 5 receives a voltage over the second operative connection (arrow 40) which is proportional to the thread unwinding speed, while the tachometer generator 41 is connected with the shaft of the motor 6, which is a part of the sliver apparatus. In the case in which the apparatus 35 is movable and is only active at a certain spinning unit during the thread joining process, a circuit 32 is provided, in which the closing of the memory 28 will be erased so that the circuit 29 opens again and the motors 5 and 6 come to a standstill. This happens only after handing over the joined thread to the spinning unit and after the simultaneous switching over of the fiber feeding to the fiber feed drive of the spinning unit.

The previous embodiments indicate that during the pre-feeding, the first operative connection, according to the arrow 38, and the beginning of the unwinding of the thread, the second operative connection according to the arrow 40 is effective to the sliver drawing-in or the fiber feeding, respectively. While the control element 14 is connected in the running cable 37 which is common for both operative connections, the pre-feeding of a fiber quantity required for thread joining, as well as the workable or commercial spin feeding, takes place after the chosen draft, for the spinning operation.

Known feeding apparatus are equipped with a constantly rotating disentangling roller, which is connected in series with a sliver drawing-in apparatus. The sliver drawing-in apparatus stands still, so the supply of the sliver toward the disentangling roller stops. Such an arrangement underlies this embodiment example. Alternatively, the fiber apparatus can be controlled directly.

The above-mentioned tachometer generator need not be limited to a special type. Generally, it is a question of an apparatus which delivers a voltage proportional to the speed.

The second operative connection, according to the arrow 40, has the advantage that during the thread joining process and at the beginning of the normal spinning operation, inadmissible draft changes are a consequence of different run up of the motors 5 and 6 and thereby, conditional or limited high spots or other unevennesses of the thread joining position are avoided. In this way, the abovementioned main advantage of the invention remains intact even under unfavorable circumstances.

The foregoing is a description corresponding to German Application No. P 31 44 761.9, dated Nov. 11, 1981, the International priority of which is being claimed for the instant application and which is hereby made part of this application. Any discrepancies between the foregoing specification and the aforementioned corresponding German application are to be resolved in favor of the latter.

We claim:

1. Apparatus for controlling a thread joining process which takes place by starting a rotor in an open end rotor spinning machine, comprising at least one spinning unit of the open end rotor spinning machine, means connected to said at least one spinning unit for controlling pre-feeding of a required fiber quantity for thread joining and for controlling fiber feed to the rotor, for return of a joined thread end to the rotor and for at least temporary control of thread unwinding from the rotor during the thread joining process, a thread unwinding device and a sliver drawing-in device connected to said control means at least during the thread joining process, a connection from said control means for pre-feeding to said sliver drawing-in device, and a control element connected in said connection at which a chosen draft for the spinning operation is adjustable.

2. Apparatus according to claim 1, including a fiber feeding device connected to said control means at least during the thread joining process and being connected to said connection.

3. Apparatus according to claim 1, including another control element connected to said control means for pre-feeding, for taking run up and run out behavior of the fiber feeding into account.

4. Apparatus according to claim 3, wherein said other control element is a function generator.

5. Apparatus according to claim 1, including a device for producing rotor signals, said connection leading from said means for production of rotor signals through said control device to said sliver drawing-in device.

6. Apparatus according to claim 2, including a device for producing rotor signals, said connection leading from said device for production of rotor signals through said control means to said fiber feeding device.

7. Apparatus according to claim 1, including another connection from said thread unwinding device to said sliver drawing-in device.

8. Apparatus according to claim 2, including another connection from said thread unwinding device to said fiber feeding device.

9. Apparatus according to claim 1, wherein said other connection is switchable.

10. Apparatus according to claim 2, wherein said other connection is switchable.

11. Apparatus according to claim 7, including a common running cable for both of said connections, leading to said silver drawing-in device.

12. Apparatus according to claim 9, including a common running cable for both of said connections, leading to said silver drawing-in device.

13. Apparatus according to claim 10, including a common running cable for both of said connections, leading to said fiber feeding device.

14. Apparatus according to claim 7, wherein said control element is connected in said running cable.

15. Apparatus according to claim 8, wherein said control element is connected in said running cable.

16. Apparatus according to claim 7, including a tachometer generator connected to said thread unwinding device in said other connection.

17. Apparatus according to claim 8, including a tachometer generator connected to said thread unwinding device in said other connection.

* * * * *